US005342285A

United States Patent [19]

Dye

[11] Patent Number: 5,342,285

[45] Date of Patent: Aug. 30, 1994

[54] ADAPTER FOR DEVICES FOR APPLYING COMPRESSIVE PRESSURE TO THE LIMBS

[75] Inventor: John F. Dye, Bridgewater, Mass.

[73] Assignee: The Kendall Company, Mansfield, Mass.

[21] Appl. No.: 901,044

[22] Filed: Jun. 19, 1992

[51] Int. Cl.[5] ..... A61H 1/00

[52] U.S. Cl. ..... 601/151; 601/148; 137/602

[58] Field of Search ..... 137/602, 561 A; 606/201, 202, 203; 601/148-153

[56] References Cited

U.S. PATENT DOCUMENTS 1,607,096 4/1923 Mueller ..... 137/602

4,029,087 6/1977 Dye ..... 128/24 R 4,280,485 7/1981 Arkans ..... 128/24 R 4,628,730 12/1986 Maguire ..... 137/602

4,718,467 1/1988 DiGianfilippo ..... 137/602

5,167,227 12/1992 Meserlian ..... 128/24 R

*Primary Examiner*—Robert A. Hafer

*Assistant Examiner*—David Kenealy

*Attorney, Agent, or Firm*—Alvin Isaacs

[57] ABSTRACT

An adapter is disclosed for converting devices for applying compressive pressure to the legs by means of a compression sleeve around the leg wherein compressed air is delivered to the sleeve through multiple conduits to like devices wherein a single conduit is utilized to supply compressed air to the sleeve.

4 Claims, 9 Drawing Sheets

PRIOR ART

PRIOR ART

ADAPTER FOR DEVICES FOR APPLYING COMPRESSIVE PRESSURE TO THE LIMBS

BACKGROUND OF THE INVENTION

It has been well documented in medical journals that the incidence of deep vein thrombosis (VT) can be significantly reduced by the use of devices for applying compressive pressure against a patient's legs. Thus, it is recognized that the velocity of blood flow in a patient's extremities, particularly the legs, markedly decreases during confinement. Such pooling or stasis of blood is particularly pronounced during surgery, immediately after surgery, and when the patient has been confined to bed for extended periods of time. It is also known that stasis of blood is a significant cause leading to the formation of thrombi in the patient's extremities, which thrombi may cause severe injury and even death.

The prevention of stasis by intermittent pneumatic compression of the legs is understood to be achieved by producing a high flow pulsatility that empties the veins periodically, cleaving not only the soleal sinuses and axial veins but also the valve sinuses in the axial veins.

The Kendall Company, assignee of the present invention, manufactures and sells under the trademarks "SCD" and "HomeRx" highly efficacious devices for applying compressive pressures to the legs. These devices include sleeves having multiple chambers which allow graded compression over the whole lower limb and which also allow the sequential application of pressures up the leg producing a wavelike milking action for optimum effect in preventing stasis.

The aforementioned commercial devices currently on the market utilize a conduit system in which four sets of conduits provide fluidized pressure from a controller to elongated inflatable sleeves around the legs. Specifically, one set of conduits provides compressive pressure to a chamber in the sleeve in the ankle region, a second set to a chamber in the calf region, a third set to a chamber in the thigh region, and a fourth set provides air for ventilating the chambers of the sleeve to cool the patient's leg.

Devices of the foregoing description utilizing four sets of conduits from a controller source of pressurized air in fluid communication with the sleeves are disclosed, for example, in U.S. Pat. No. 4,253,449 of Arkans et al and assigned to The Kendall Company, which patent will be discussed in more detail hereinafter.

In view of the commercial success of sequential compressive devices of this description over the years, it follows that many thousands of controllers for these four-conduit devices are currently found in hospitals and clinics throughout the United States as well as other countries where they are available.

Another system for applying compressive pressure to the limb utilizes what may be termed a "single conduit device" wherein air from the controller is transmitted by a single conduit to the ankle chamber of the sleeve and then from the ankle chamber where introduced into the sleeve successively upward to the calf and thigh chambers. Devices of this description utilizing a single conduit from the controller sources of air to the compression sleeve are disclosed, for example, in U.S. Pat. No. 4,029,087 issued to Dye et al and assigned to The Kendall Company, which patent will also be discussed in more detail hereinafter.

When single conduit devices such as those described in the aforementioned Dye et al patent subsequently become available, it will be extremely desirable to provide clinicians with the ability to utilize the controllers currently in house for use with both the multiconduit devices currently available and the single conduit devices as they subsequently become available.

Stated simply, the task of this invention is to devise means for making the controllers now available for devices for applying compressive pressure to the legs adaptable for use in both the current multiconduit systems and single conduit systems.

BRIEF DESCRIPTION OF THE INVENTION

In accordance with this invention, this task is solved in an elegant manner by providing adapter means for converting from a multiconduit to a single conduit system. In one embodiment of the invention, the adapter communicates directly with the controller to convert the system to the singly conduit one. In other embodiments of the invention, the adapter means effects the conversion to the single conduit system downstream between the controller and the sleeve.

DETAILED DESCRIPTION OF THE PREFERRED EMBODIMENTS

As was heretofore mentioned, the task of this invention is to provide means for making the controllers currently in house for providing compressive air to multiconduit sleeves for applying compressive pressure to the limb useful as well with sleeves wherein a single conduit is employed to introduce air from the controller into the sleeve.

The nature and objects of the invention may best be understood by reference to the drawings taken in conjunction with the accompanying detailed description.

Figure 1:
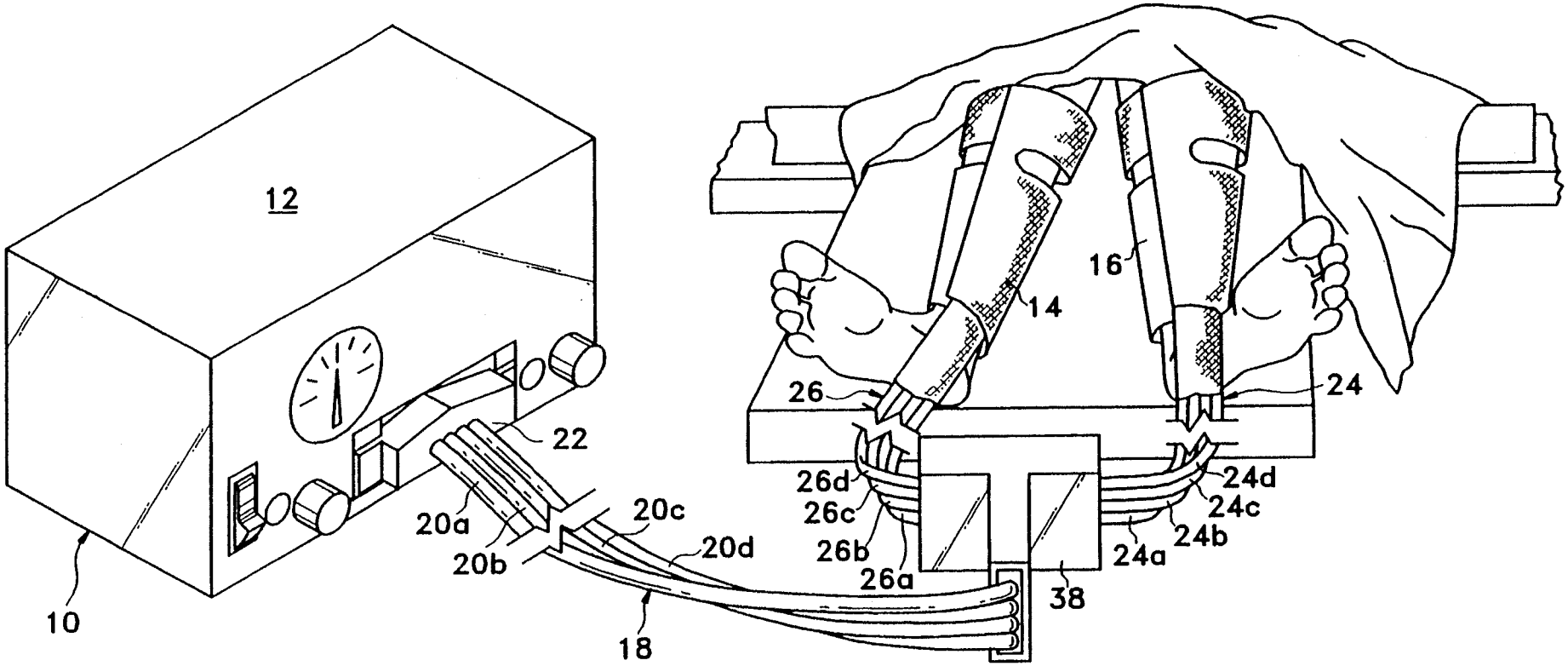
PRIOR ART Fig. 1
FIG. 1 is a fragmentary perspective view of a prior art multiconduit device as shown in FIG. 1 of the aforementioned U.S. Pat. No. 4,253,449.

As shown in FIG. 1, the prior art multiconduit systems such as the "SCD" intermittent compression devices currently on the market comprise device 10 having a controller 12 as the source of air under pressure for applying compressive pressure to sleeves 14 and 16 around a patient's legs. After placement around the patient's legs, the controller 12 may be initiated in order to supply air to the legs through conduit system 18. As shown, conduit system 18 has a first set of conduits 24*a*, 24*b*, 24*c* and 24*d* communicating with the chambers (not shown) of sleeve 24 and a second set of conduits, 26*a*, 26*b*, 26*c* and 26*d* communicating with the chambers (not shown) of the second sleeve. The means by which the respective sets of conduits communicate with the chambers of the sleeves is well known and understood and need not be discussed in any detail for a clear understanding of the present invention other than to point out that in the manner fully disclosed in the aforementioned U.S. Pat. No. 4,253,449, conduits 24*a* and 26*a* communicate with the ankle chambers of the sleeves, 24*b* and 26*b* provide ventilating air to the chambers, 24*c* and 26*c* communicate with the calf chambers of the sleeves and conduits 24*d* and 26*d* communicate with the thigh chambers of the sleeves.

The conduit system 18 also has a third set of conduits, 20*a*, 20*b*, 20*c* and 20*d* in communication with controller 12 by means of connector 22. A T-shaped connection member 38 connects the conduits of the first and second sets 24 and 26 with the third set 20 such that conduit 20*a* from the controller is in fluid communication exclusively with conduits 24*a* and 26*a*, conduit 20*b* exclusively with conduits 24*b* and 26*b*, conduit 20*c* exclusively with conduits 24*c* and 26*c* and conduit 20*d* exclusively with conduits 24*d* and 26*d*.

Figure 2:
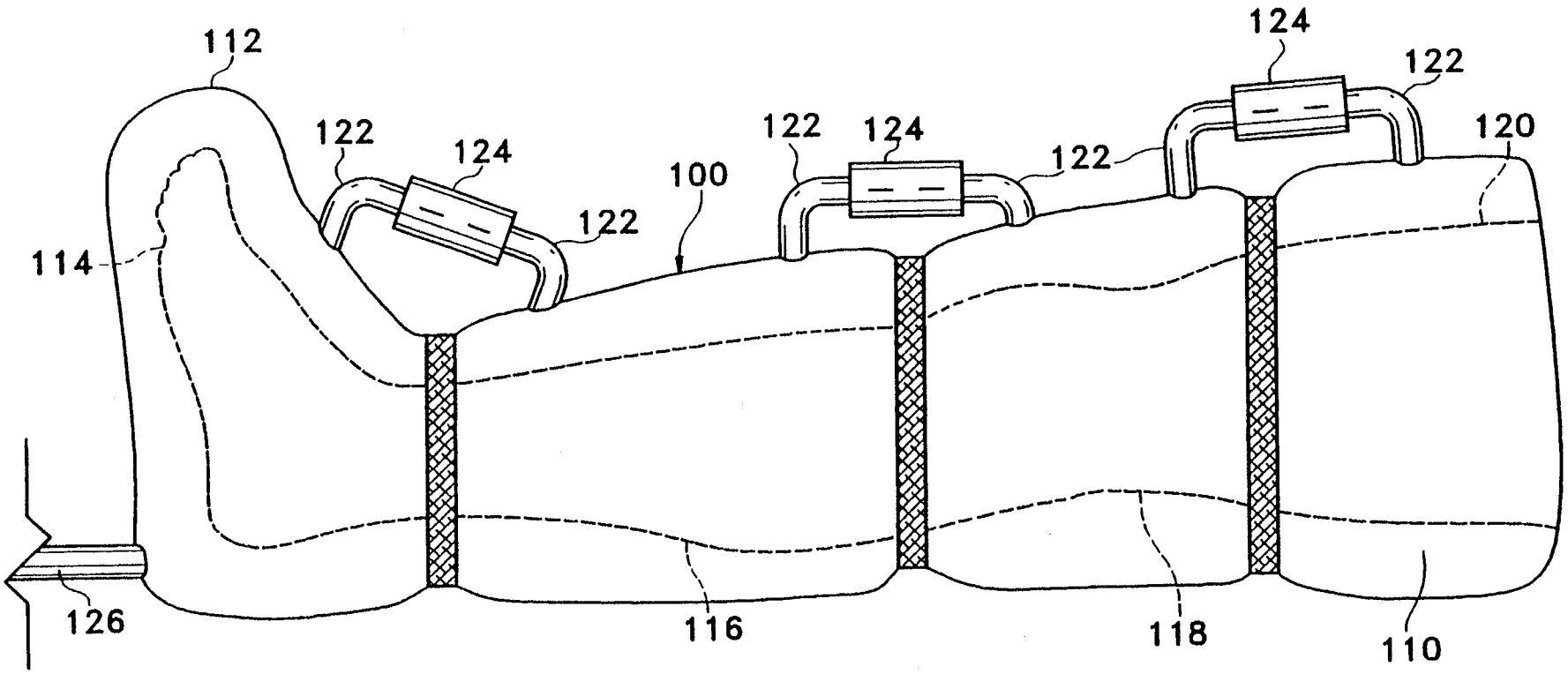
FIG. 2 is an elevational view of a prior art single conduit device as shown in FIG. 5 of the aforementioned U.S. Pat. No. 4,029,087.
Figure 5:
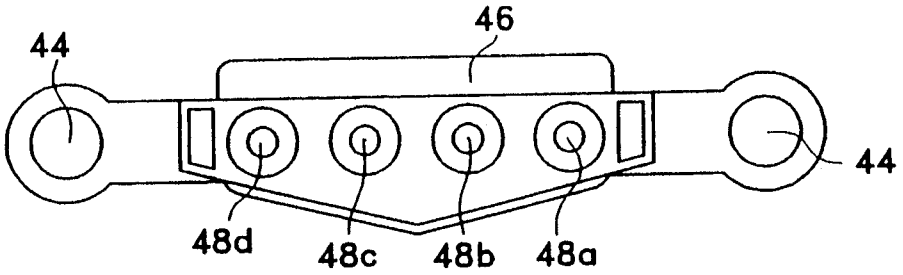
FIG. 5 is an elevational view of the rear of the adapter of FIG. 4.

FIG. 2, which is derived from FIG. 5 of the aforementioned U.S. Pat. No. 4,029,087, is illustrative of the prior art compression devices utilizing a single conduit to the sleeves. As shown, compression device 100 comprises a sleeve 110 having a foot portion 112 defining the lowermost pressure chamber 114 and separate fluid pressure chambers 116, 118 and 120 extending progressively up the leg. A plurality of tube sections 122 and associated valve means 124 connecting adjoining chambers during compression cycles, as controlled by a timing device or controller (not shown) in fluid communication with conduit 126 for emitting compressive air into the lowermost chamber 114 of sleeve 110. As described in detail in U.S. Pat. No. 4,029,087 the valves permit sequential inflation of the chambers with air initially entering the lowermost chamber 114 via conduit 126.

In the foregoing discussion, the alternative multiconduit and single conduit systems known in the art have only been described briefly. While more detailed discussion is not necessary to a clear understanding of the present invention, for a more detailed discourse, reference may be had to the respective specification of the aforementioned patents, which specifications are incorporated by reference herein.

Figure 3:
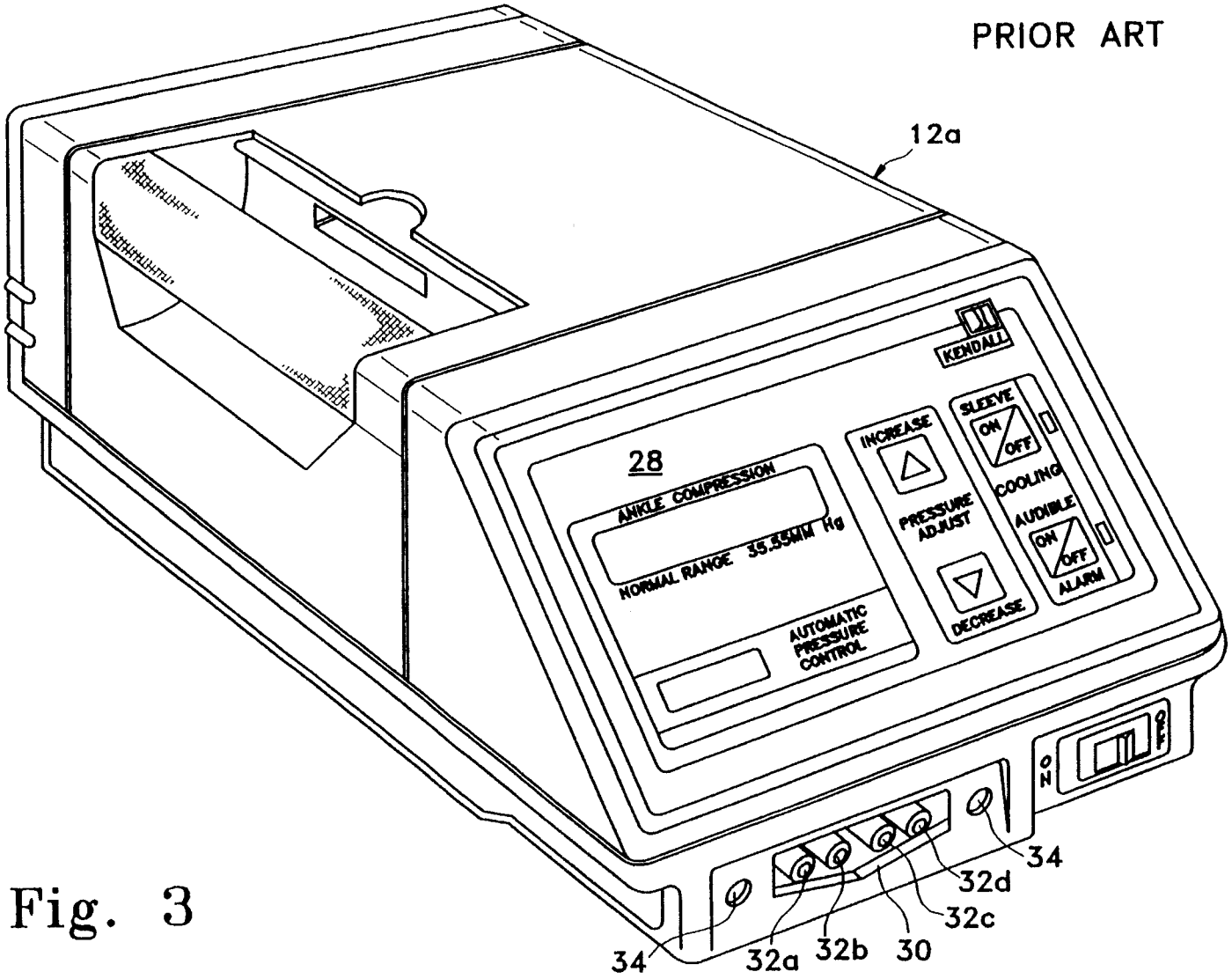
FIG. 3 is a perspective view illustrating a prior art controller for providing compressive air to the sleeves in a multiconduit system.

FIG. 3 illustrates a controller commercially available for use with the multiconduit SCD devices. As shown, controller 12*a* has a control panel 28 for controlling the operation of the device. Without going into further detail, the control panel has means for turning the device off and on, for setting the desired pressures to the respective chambers of the sleeve, for ventilating and an alarm signal in the unlikely event that the pressures within the chambers become undesirably high. The controller has a chevron-shaped recess area for releasably securing a connector for conduits 20*a*, 20*b*, 20*c* and 20*d* in fluid communication with air outlet ports 32*a*, *b*, *c*, and *d* respectively.

With the foregoing discussion of the prior art essentially as background for understanding the nature and objects of the present invention, attention is now invited to the following discussion of FIGS. 4–12, the remaining figures of the drawings.

FIGS. 4–7 describe a particularly preferred embodiment of the invention wherein the connector means to the controller is provided with an adapter for converting from multiconduits leading to separate chambers such as would be employed with the prior art sleeves illustrated in FIG. 1 to a single conduit to be employed with sleeves such as those illustrated in FIG. 2 wherein pressurized air is introduced into the lowermost chamber and from there to successive upper chambers.

Figure 4:
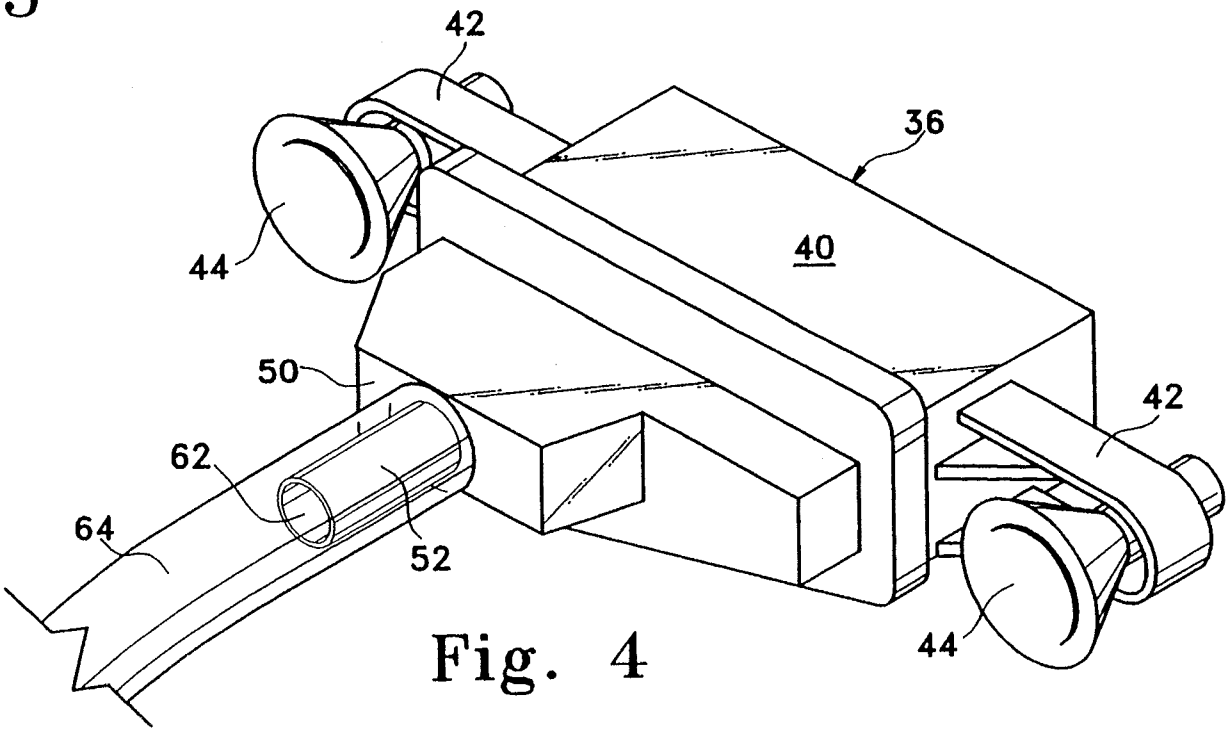
FIG. 4 is a perspective view of an adapter of this invention for insertion into the controller of the type shown in FIG. 3 to convert from multiconduit to single conduit.

With reference first to FIGS. 4 and 5, the novel adapter 36 for the controller has a housing 40 with extensions 42, a rear panel 46 and a front portion 50. Mounted in extensions 42 on either side of the housing are connectors 44 of per se known structure which will lock into openings 34 (as seen in FIG. 3) to releasably secure the adapter within opening 30 of the controller. As seen in FIG. 5, the rear panel 46 of the adapter 36 is chevron-shaped to conform with the opening 30 in the controller. When the adapter 36 is seated within the opening 34 so as to releasably secure the adapter thereto, female ports 48 *a*, *b*, *c*, and *d* mate in fluid communication with male ports 32*a*, *b*, *c*, and *d* respectively of the controller.

Figure 7:
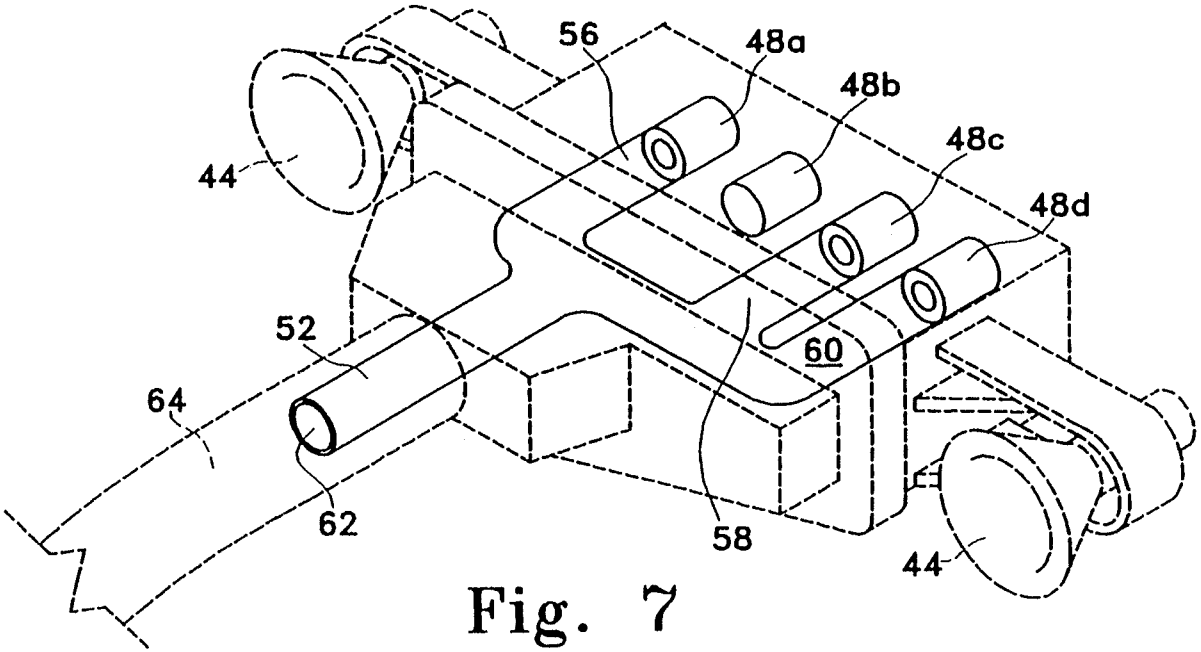
FIG. 7 is a perspective view showing the placement of the manifold of FIG. 6 within the adapter.
Figure 6:
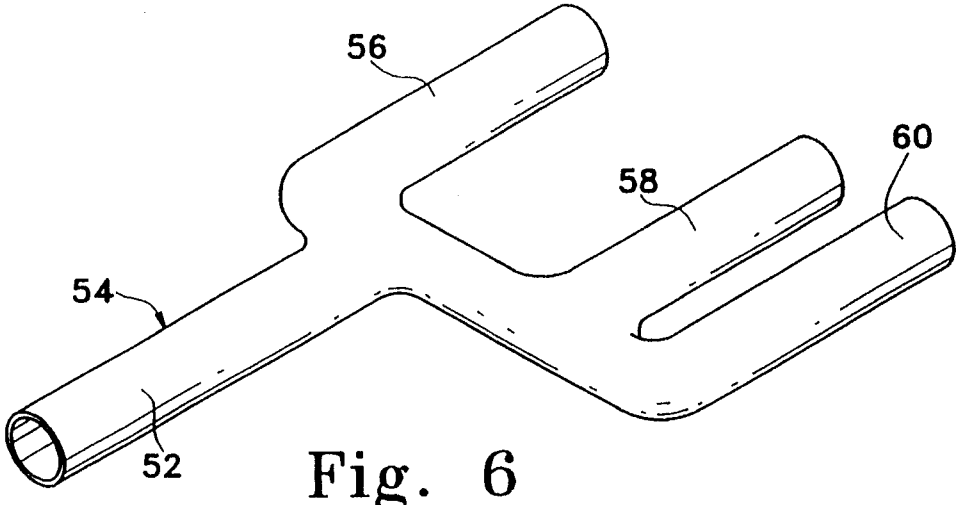
FIG. 6 is a perspective view of a multilumen manifold component part of the adapter of FIG. 4.

As seen in FIGS. 6 and 7, the adapter has a multilumen manifold 54, having rearward lumens 56, 58 and 60 communicating with a forward lumen 52. Manifold 54 is seated within the adapter 36 with lumens 56, 58 and 60 overlying and thereby in fluid communication with the rear portion of ports 48*a*, *c*, and *d*, respectively. In this manner, the adapter is in fluid communication with exit ports 32*a*, *b*, and *d*, respectively of the controller. As seen in FIGS. 4 and 7, a single conduit 64 overlies lumen 52 so that air emitted from ports 32*a*, *c* and *d* to inflate the chambers then passes through opening 62 in lumen 52 and then into the single conduit 64. It will of course be appreciated, that the T-connector for splitting the compressed air into conduits leading to both sleeves will be modified to provide a multilumen manifold having a single lumen to which conduits leading to the respective sleeves are in fluid communication. The manner of so modifying the T-connector to provide for single conduits rather than multiple conduits will be within the expected judgment of the skilled worker in the light of the foregoing description and accordingly per se comprises no part of the present invention.

From the foregoing description, it will be seen that the three ports of the controller 32 *a*,*c* and *d* for applying compressive air to inflate the chambers are channeled into a single conduit with no means for providing ventilation from the air emitted through port 32*b*. It will be understood however, that other means for ventilating the chambers may be provided or, alternatively, a second conduit may be provided for communication between ventilating port 32*b* and the sleeve. Accordingly, as used herein and in the appended claims, the term "single conduit" or "single conduit device" refers only to the conduit system for inflating the chambers so as to provide compressive pressure to the limb and does not exclude the possibility, if so desired, of a second conduit for ventilation.

Figure 8:
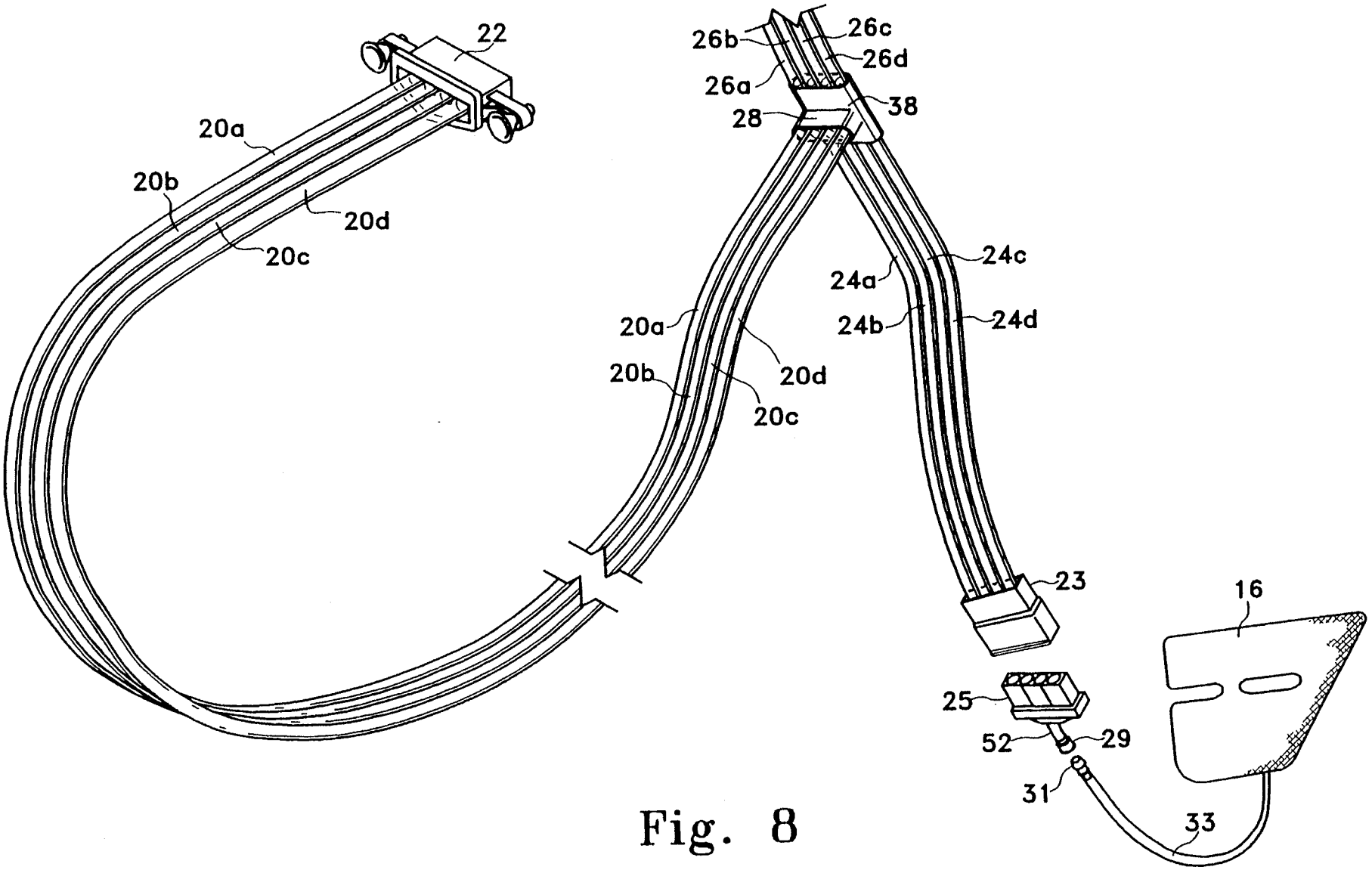
FIG. 8 is a fragmentary perspective view of the conduit system in another embodiment of the invention.
Figure 9:
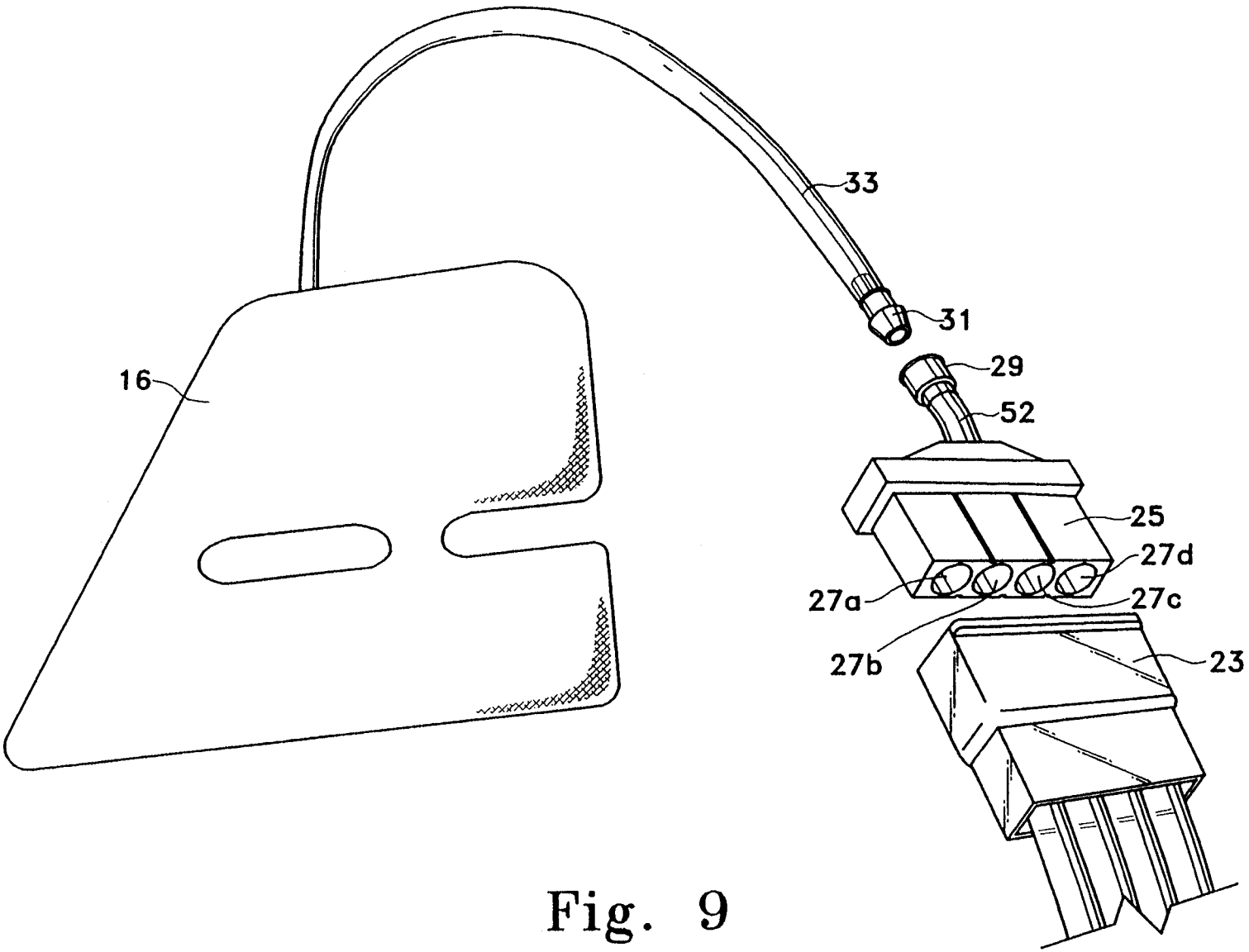
FIG. 9 is a fragmentary perspective view of a portion of the conduit system of the embodiment of FIG. 8 enlarged for purposes of illustration.

FIGS. 8 and 9 relate to another embodiment of the invention whereby conversion from a multiconduit system to a single conduit one takes place downstream between the T-connection and the sleeves.

As best seen in FIG. 9, conduit 33 for inflating the chambers (not shown) in sleeve 16 is provided with a male snap fitting 31 to secure the conduit to female fitting 29 of adapter 25. In the manner described in the previously discussed embodiment, adapter 25 is provided with multilumen manifold 54 (FIG. 6) in communication with ports 27*a, c* and *d* of the adapter. The ports 27*a, b, c* and *d* then mate with corresponding ports (not shown) in connector 23, thereby placing single lumen 33 in fluid communication with air emitted from ports 32*a, c* and *d* of the controller.

Figure 10:
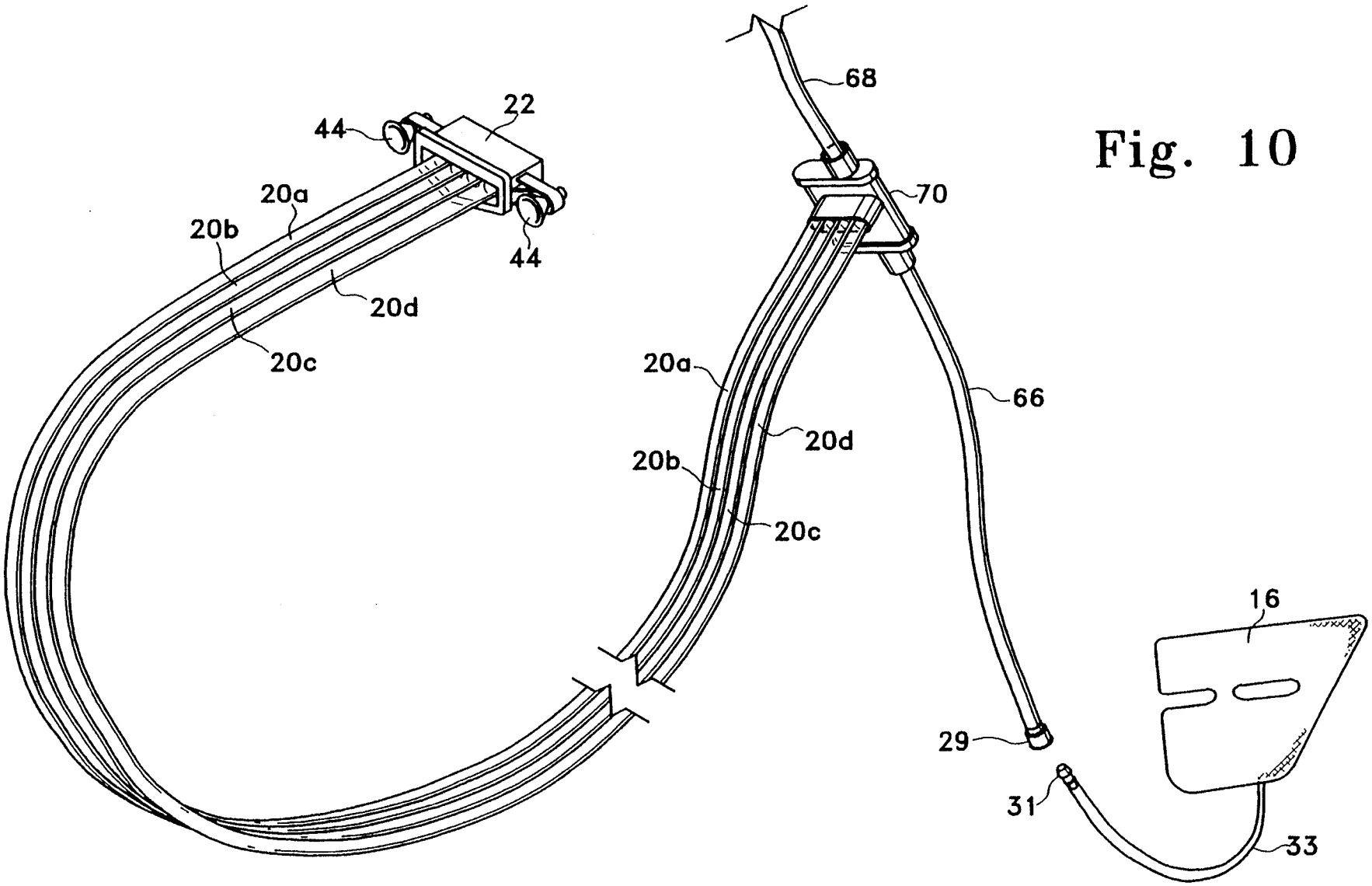
FIG. 10 is a fragmentary perspective view of the conduit system in yet another embodiment of this invention.
Figure 11:
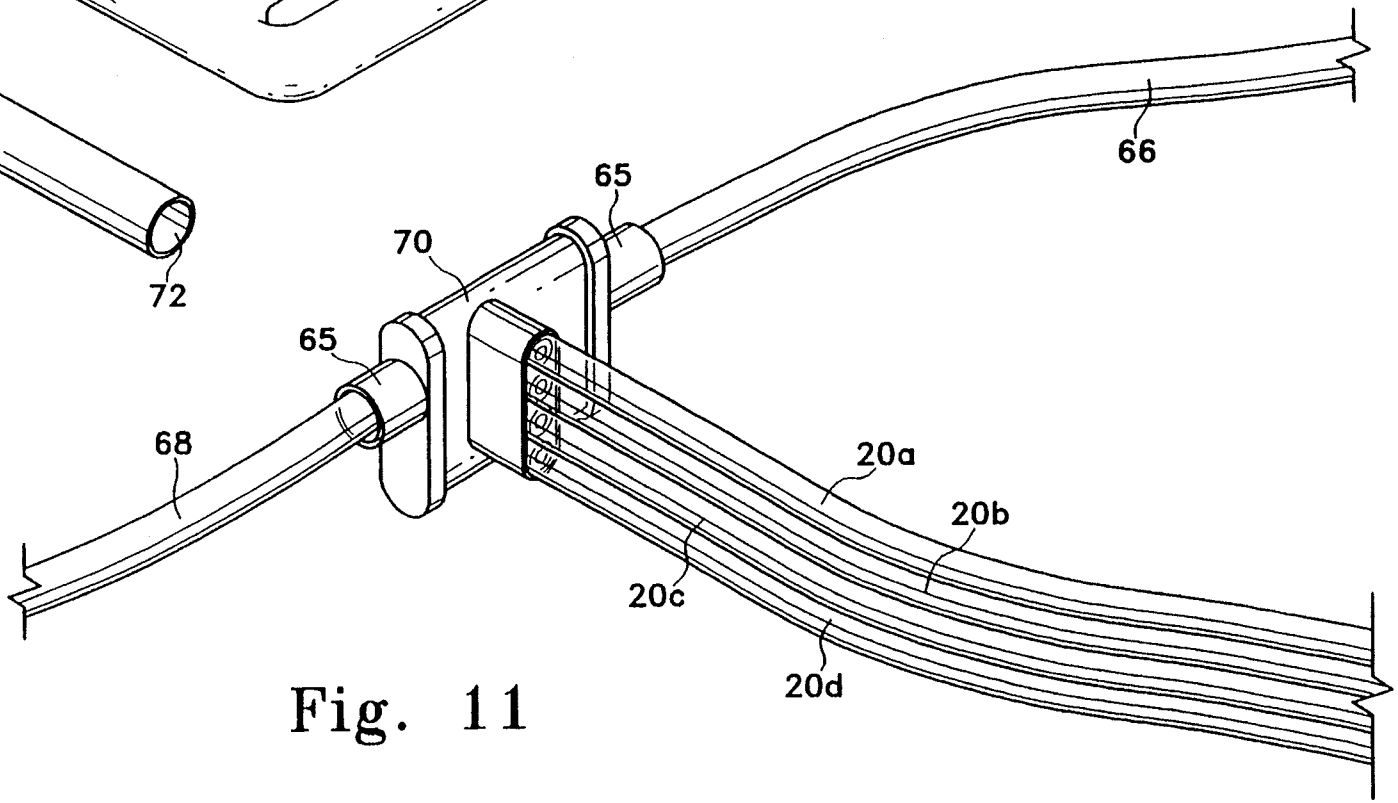
FIG. 11 is a fragmentary perspective view of a portion of the conduit system of the embodiment of FIG. 10 enlarged for purposes of illustration.
Figure 12:
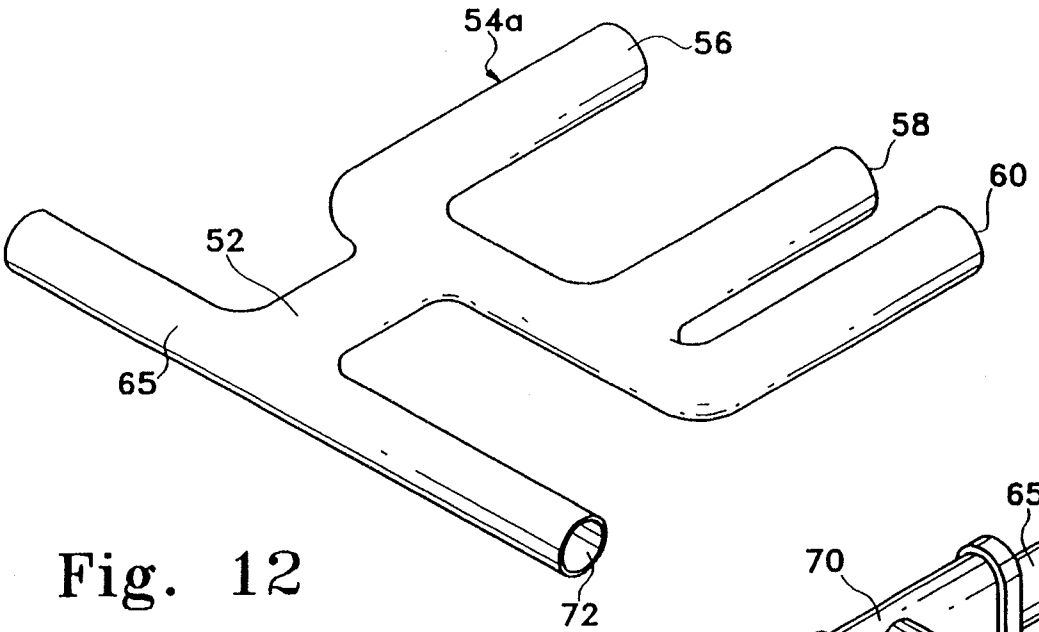
FIG. 12 is a perspective view of a multilumen manifold for the adapter employed in the embodiment shown in FIGS. 10 and 11.

Yet another embodiment of the invention is illustrated in FIGS. 10–12 wherein the conversion from a multiconduit system to a single conduit one is provided by modification of the T-connector for splitting the compressed air to separate conduits leading to the two sleeves. With like components having like numerals, T-connector 70 has been modified from the previously described configuration 38 to split air coming from the controller through conduits 20*a, c,* and *d* into single conduits 66 and 68 leading to sleeves 16 and 18 respectively.

With reference to FIG. 12, this is accomplished by modifying multilumen manifold 54*a* from the configuration of FIG. 6 so that lumen 52 communicates with lumen 65 having an opening 72 at either end for fluid communication from T-connector 70 to each of the conduits 66 and 68 leading to the sleeves.

From the foregoing description, it will thus be seen that the present invention permits the clinician or other user to employ the existing in house controller for pressurized air with either sleeves provided with multiconduits leading to the individual chambers of the sleeves to sleeves having but a single conduit in communication with a source of pressurized air for inflating the chambers. The adaptability from one system to another is accomplished quickly and economically without resort to modification of the controller itself by means of the novel adapter/connectors of this invention. Accordingly, it will thus be seen that only a single controller need be provided for these alternate sleeve systems.

As is well known by those skilled in the art, in the multiconduit systems such as the commercially available SCD and HomeRx systems, controls for the sequential delivery of pressurized fluid to provide prescribed amounts of the pressure to the chambers of the sleeves is provided automatically by settings in the controller. However, when the air emitted from the controller is then funneled into a single conduit for delivery to the sleeve, such controls are no longer possible. Accordingly, they must be provided by the sleeve itself. Systems for providing sequential inflation of the chambers along with a gradation in pressure with the maximum pressure being exerted in the lowermost chamber are described in detail in the aforementioned U.S. Pat. No. 4,029,087 and need not be discussed further in this application other than to note that one method of so doing utilizes tube connections 122 and valves 124 as shown in FIG. 2. Other means of doing so, whether requiring inventive skills or not, may be employed without departing from the scope of the invention herein contemplated.

Since certain changes may be made without departing from the scope of the invention herein contemplated, it is intended that the drawings along with their description be taken as illustrative and not in a limiting sense.

What is claimed is:

1. A device for providing pressurized fluid for delivery to an elongated compression sleeve for applying compressive pressure to the leg through a single conduit in fluid communication with a single chamber within the sleeve, the device comprising, in combination, a source of pressurized fluid, the source having at least three outlet ports for emitting pressurized fluid to multiple conduits, each of which conduits is in fluid communication with a separate compression chamber within the sleeve;

an adapter for converting the source to one for use with sleeves having a single conduit for receiving pressurized fluid, the adapter comprising a housing having a trailing end for receiving pressurized fluid and a leding end for emitting the pressurized fluid to the single conduit, the trailing end of the housing having at least three ports each of which is adapted to mate in fluid communication with one of the outlet ports in the source of pressurized fluid, means within the housing for receiving fluid emitted through the ports at the trailing end of the housing, a lumen having a trailing end and a leading end, the trailing end of the lumen being in fluid communication with the means within the housing for receiving pressurized fluid, the leading end of the lumen extending through the leading end of the housing and having an opening through which pressurized fluid emanating from the source may be received by a single conduit system to the sleeve;

an elongated compression sleeve for applying compressive pressure to a patient's leg, the sleeve having a single conduit for delivering pressurized fluid to the sleeve, the conduit being in fluid communication with the leading end of the lumen extending through the housing; and means for releasably securing the adapter in fluid communication with the source with the ports in the trailing end of the housing in fluid communication with outlet ports in the source.

2. A device as defined in claim 1 wherein the source of pressurized fluid includes a control panel having a recessed area in which the outlet ports are situated.

3. A device as defined in claim 2 in which the adapter housing has a rear panel conforming in shape to the recessed area of the control panel and being of slightly smaller dimensions whereby when the adapter is releasably secured to the source, the rear panel of the adapter housing is seated within the recessed area.

4. A device as defined in claim 3 wherein the recessed area and the rear panel of the adapter housing are substantially chevron-shaped.

* * * * *